US011697944B2

(12) United States Patent
Andrawes

(10) Patent No.: US 11,697,944 B2
(45) Date of Patent: Jul. 11, 2023

(54) METHOD TO STRENGTHEN OR REPAIR CONCRETE AND OTHER STRUCTURES

(71) Applicant: The Board of Trustees of the University of Illinois, Urbana, IL (US)

(72) Inventor: Bassem Andrawes, Mahomet, IL (US)

(73) Assignee: THE BOARD OF TRUSTEES OF THE UNIVERSITY OF ILLINOIS, Urbana, IL (US)

( * ) Notice: Subject to any disclaimer, the term of this patent is extended or adjusted under 35 U.S.C. 154(b) by 354 days.

(21) Appl. No.: 17/068,099

(22) Filed: Oct. 12, 2020

(65) Prior Publication Data

US 2021/0115684 A1 Apr. 22, 2021

Related U.S. Application Data

(60) Provisional application No. 62/915,684, filed on Oct. 16, 2019.

(51) Int. Cl.
*E04G 21/12* (2006.01)
*E04G 23/02* (2006.01)
(Continued)

(52) U.S. Cl.
CPC ..... *E04G 21/12* (2013.01); *B28B 23/04* (2013.01); *E04G 23/02* (2013.01); *E04C 5/012* (2013.01); *E04C 5/12* (2013.01)

(58) Field of Classification Search
CPC ..... E04G 21/12; E04G 23/02; E04G 23/0218; E04C 5/012; E04C 5/12
See application file for complete search history.

(56) References Cited

U.S. PATENT DOCUMENTS 5,981,630 A * 11/1999 Banthia ..... C04B 28/02 428/371
7,523,924 B2 * 4/2009 Melancon ..... E04C 5/02 428/113
(Continued)

FOREIGN PATENT DOCUMENTS

CN 104806022 B 7/2015
CN 104816381 A 8/2015
(Continued)

OTHER PUBLICATIONS

Alam et al., "Utilizing shape memory alloys to enhance the performance and safety of civil infrastructure: a review," *Canadian Journal of Civil Engineering*, 34 (9) (2007) pp. 1075-1086.
(Continued)

*Primary Examiner* — Christine T Cajilig
(74) *Attorney, Agent, or Firm* — Crowell & Moring LLP

(57) ABSTRACT

A method to strengthen or repair concrete and other structures comprises securing a plate having a shape memory alloy (SMA) wire embedded therein to a localized region of a structure. The SMA wire has a deformed shape configured for self-anchorage within the plate. The SMA wire is heated at or above an austenite transformation temperature, and the SMA wire resists shape recovery and remains self-anchored within the plate. Accordingly, a compressive force is generated within the SMA wire and transferred to the plate. At an interface between the plate and the localized region of the structure, the compressive force is transmitted from the plate to the structure, thereby providing localized prestressing of the structure.

20 Claims, 10 Drawing Sheets

(51) Int. Cl.

| | |
|---|---|
| ***E04C 5/01*** | (2006.01) |
| ***E04C 5/12*** | (2006.01) |
| ***B28B 23/04*** | (2006.01) |

(56) References Cited

U.S. PATENT DOCUMENTS

| | | | | |
|---|---|---|---|---|
| 9,758,968 | B2 * | 9/2017 | Leinenbach | C22C 38/14 |
| 10,208,493 | B1 * | 2/2019 | Sim | E04C 5/0622 |
| 2011/0101266 | A1 * | 5/2011 | Thomas | E04C 5/01 428/397 |
| 2018/0023297 | A1 * | 1/2018 | Dawood | B32B 15/08 29/402.09 |
| 2018/0111348 | A1 * | 4/2018 | Lee | B32B 5/024 |
| 2022/0034096 | A1 * | 2/2022 | Sarrablo Moreno | E04F 13/0826 |

FOREIGN PATENT DOCUMENTS

| | | | | |
|---|---|---|---|---|
| KR | 20110006072 | A | 1/2011 | |
| KR | 101946731 | B1 | 2/2019 | |
| WO | WO-9612588 | A1 * | 5/1996 | B23P 6/04 |
| WO | WO-2019175065 | A1 * | 9/2019 | |

OTHER PUBLICATIONS

Andrawes et al., "Seismic retrofitting of bridge columns using shape memory alloys, " *Proc. SPIE*, vol. 6928 (2008) pp. 1-10.
Arab et al.,"A methodological approach for finite element modeling of pretensioned concrete members at the release of pretensioning," *Engineering Structures*, 33 (6) (2011) pp. 1918-1929.
Bilotta et al., "Efficienty of CFRP NSM strips and EBR plates for flexural strengthening of RC beams and loading pattern influence," *Composite Structures*, 124 (2015) pp. 163-175.
Chavez et al., "Design of a post-tensioned prestressed concrete pavement, construction guidelines, and monitoring plan," (Report FHWA/TX04/0-4035-1). Austin, TX: Texas Department of Transportation, Aug. 2003, pp. 1-342.
Chen et al., "T-section RC beams shear-strengthened with anchored CFRP U-strips," *Composite Structures*, 144 (2016) pp. 57-79.
Chen et al., "Thermomechanical testing of FeNiCoTi shape memory alloy for active confinement of concrete," *Smart Materials and Structures*, 23, 055015 (2014) pp. 1-12.
Choi et al., "Crack-closing of cement mortar beams using NiTi cold-drawn SMA short fibers," *Smart Materials and Structures*, 24, 015018 (2014), pp. 1-12.
Chung et al., "Application of post-tension technology on tall buildings," *International Journal of High-Rise Buildings*, 6, 3 (2017) pp. 285-296.
Corven et al., Post-Tensioning Tendon Installation And Grouting Manual (Technical Report FHWA-NHI-13-026). Washington, D.C.: Federal Highway Administration, (2013) pp. 1-184.
Czaderski et al., "Feasibility of iron-based shape memory alloy strips for prestressed strengthening of concrete structures," *Construction and Building Materials*, 56 (2014) pp. 94-105.
Deng et al., "Behavior of concrete beam with embedded shape memory alloy wires," *Engineering Structures*, 28,12 (2006) pp. 1691-1697.
Dommer et al., "Thermomechanical Characterization of NiTiNb Shape Memory Alloy for Concrete Active Confinement Applications," *Journal of Materials in Civil Engineering*, 24, 10 (2012) pp. 1274-1282.
Dong, et al. A novel Fe—Mn—Si shape memory alloy with improved shape recovery properties by VC precipitation. *Advanced Engineering Materials* 11 (2009) (Abstract).
El-Hacha et al., "Flexural strengthening of reinforced concrete beams using prestressed, near-surface-mounted CFRP bars," *PCI Journal*, 56, 4 (2011) pp. 134-151.
Gangi et al., "Evaluation of repair techniques for impact-damaged prestressed beams," Final Report, Virginia Transportation Research Council, Charlottesville, VA (2018) pp. 1-80.
Harries et al., "Repair methods for prestressed concrete girders," Final Report, Commonwealth of Pennsylvania Dept. of Transportation (2009) pp. 1-178.
Kim et al., "Repair of Bridge Girder Damaged by Impact Loads with Prestressed CFRP Sheets," *Journal of Bridge Engineering*, 13, 1 (2008) pp. 15-23.
Kuenzi, "Determination of mechanical properties of adhesive for use in the design of bonded joints," Report No. 1851, U.S. Department of Agriculture (1956) pp. 1-23.
Li et al., "Study on reinforced concrete beams strengthened using shape memory alloy wires in combination with carbon-fiber-reinforced polymer plates," *Smart Materials and Structures*, 16, 6 (2007) pp. 2550-2559.
McCormick et al., "Digital image correlation," *Materialstoday*, 13, 12 (2010) pp. 52-54.
Melton et al., "Wide hysteresis shape memory alloys based on the NiTiNb System," MRS International Meeting on Advanced Materials, Shape Memory Materials, vol. 9 (1989) pp. 1-6.
Nie et al., "Experimental study on RC T-section beams with an FRP-strengthened web opening," *Composite Structures*, 185 (2018) pp. 273-285.
Oh et al., Realistic evaluation of transfer lengths in pretensioned prestressed concrete members. *ACI Structural Journal*, 97, 6 (2000) (Abstract).
Park et al., "Prestressing the Precast Concrete slabs with external cables," *KSCE Journal of Civil Engineering*, 4, 1 (2000) pp. 11-18.
Rius et al., "Active shear strengthening of RC beams using shape memory alloys," In: *SMAR 2017—4th Conference on Smart Monitoring, Assessment and Rehabilitation of Civil Structures*, Zurich, Switzerland, Sep. 13-15, 2017, pp. 1-8.
Rius et al., "Shear strengthening of reinforced concrete beams using shape memory alloys," *Construction and Building Materials*, 200 (2019) pp. 420-435.
Rogowsky et al., *Detailing for Post-Tensioning*, VSL International Ltd., Lyssach, Switzerland (1991) pp. 1-52.
Rose et al., "Investigation Of Standardized Tests To Measure The Bond Performance Of Prestressing Strand," *PCI Journal*, 42, 4 (1997) pp. 56-80.
Sawaguchi et al., "Development of Prestressed Concrete Using Fe—Mn—Si-Based Shape Memory Alloys Containing NbC," *Materials Transactions*, 47, 3 (2006) pp. 580-583.
Seo et al., "Flexural strength of RC beam strengthened by partially de-bonded near surface-mounted FRP strip," *International Journal of Concrete Structures and Materials*, 10, 2 (2016) pp. 149-161.
Shahverdi et al., "Strengthening of RC beams by iron-based shape memory alloy bars embedded in a shotcrete layer," *Engineering Structures*, 117 (2016) pp. 263-273.
Shaji et al., "Self-centering of shape memory alloy fiber reinforced cement mortar members subjected to strong cyclic loading," *Materials and Structures*, 46, 4 (2012) pp. 651-661.
Shaw et al., "Repair of damaged end regions of PC beams using externally bonded FRP shear reinforcement," *Construction and Building Materials*, 148 (2017) pp. 184-194.
Shin et al., "Experimental investigation of actively confined concrete using shape memory alloys," *Engineering Structures*, 32 (2010) pp. 656-664.
Soroushian et al., "Repair and strengthening of concrete structures through application of corrective posttensioning forces with shape memory alloys," *Transportation Research Record*, 1770, 3 (2001) pp. 20-26.
Sreejith, "Flexural behaviour of prestressed hollow slab," *International Journal of Civil Engineering and Technology*, 8, 3 (2017) pp. 90-99.
Tadros et al., "Precast, prestressed girder camber variability," *PCI Journal*, 56, 1 (2011) pp. 135-154.
Tatar et al., "Direct Shear Adhesive Bond Test," *11th International Symposium on Fiber Reinforced Polymers for Reinforced Concrete Structures*, Guimarães, Portugal, (Jun. 26-28, 2013) pp. 1-11.
Wu et al. "Flexural behavior of concrete beams strengthened with new prestressed carbon-basalt hybrid fiber sheets," *Journal of Composites for Construction*, 18, 4 (2014) pp. 1-10.

(56) References Cited

OTHER PUBLICATIONS

Zhao et al., "Mechanical properties of NiTiNb Shape Memory Alloy Subjected To A Harsh Corrosive Environment," *Journal of Materials in Civil Engineering*, 29, 3 (2017) pp. 1-9.

* cited by examiner

METHOD TO STRENGTHEN OR REPAIR CONCRETE AND OTHER STRUCTURES

RELATED APPLICATION

The present patent document claims the benefit of priority under 35 U.S.C. § 119(e) to U.S. Provisional Patent Application No. 62/915,684, which was filed on Oct. 16, 2019, and is hereby incorporated by reference in its entirety.

TECHNICAL FIELD

The present disclosure is related generally to concrete prestressing and more specifically to a method of locally prestressing concrete and/or other structures.

BACKGROUND

Concrete prestressing techniques including pretensioning and post-tensioning have been widely used to improve the flexural and shear capacity of concrete structures. Pretensioning is primarily used in the construction of new precast components, while post-tensioning is typically applied in new cast-in-place construction or in the repair/strengthening of existing structures. The application of both techniques traditionally involves the anchorage and mechanical jacking of the prestressing reinforcement, which imposes practical constraints on the position and orientation of the reinforcement, especially in small regions. Using existing methods, applying prestressing locally in a relatively small region, such as the end region of a girder or the plastic hinge region of a column, can be problematic and in some cases unfeasible.

BRIEF SUMMARY

A new method to strengthen or repair concrete and other structures has been developed. The method comprises securing a plate having a shape memory alloy (SMA) wire embedded therein to a localized region of a structure. Within the plate, the SMA wire has a deformed shape configured for self-anchorage. The SMA wire is heated at or above an austenite transformation temperature, and the SMA wire resists shape recovery and remains self-anchored within the plate. Accordingly, a compressive force is generated within the SMA wire and transferred to the plate. At an interface between the plate and the localized region of the structure, the compressive force is transmitted, thereby providing localized prestressing of the structure.

BRIEF DESCRIPTION OF THE DRAWINGS

FIG. 3B provides a partial side view of the girder with attached plate, and FIG. 3C shows a perspective view of the plate before attachment.

FIG. 3E provides a partial side view of the girder with attached plate; FIG. 3F shows a perspective view of the plate before attachment; and FIG. 3G shows an example of a curved plate shaped to attach to a curved structure.

FIG. 5A shows a front view of the girder, FIG. 5B shows a close-up front view, and FIG. 5C shows a top view of the plate.

FIG. 5D shows a front view of the girder and FIG. 5E shows a close-up front view.

DETAILED DESCRIPTION

A new method to apply local prestressing to concrete or other structures for strengthening and/or repair is described in this disclosure. The method utilizes a plate including an embedded, deformed reinforcement wire comprising a shape memory alloy that may be secured to a localized region of a structure. Upon heating, a compressive prestress is generated by the reinforcement wire in the plate and transmitted to the localized region of the structure. Before the method is described in detail, shape memory alloys and their applicability to prestressing are explained.

A shape memory alloy is a type of metallic material that can recover its original shape after experiencing excessive deformation upon exposure to heat. This unique effect is triggered by a phase transformation between martensite and austenite and is governed by four transformation temperatures: martensite start temperature, martensite finish temperature, austenite start temperature, and austenite finish temperature. As would be known to one of ordinary skill in the art, martensite start temperature ($M_s$) is the temperature at which a phase transformation to martensite begins upon cooling, martensite finish temperature ($M_f$) is the temperature at which the phase transformation to martensite concludes upon cooling, austenite start temperature ($A_s$) is the temperature at which a phase transformation to austenite begins upon heating, and austenite finish temperature ($A_f$) is the temperature at which the phase transformation to austenite concludes upon heating.

Figure 1A:
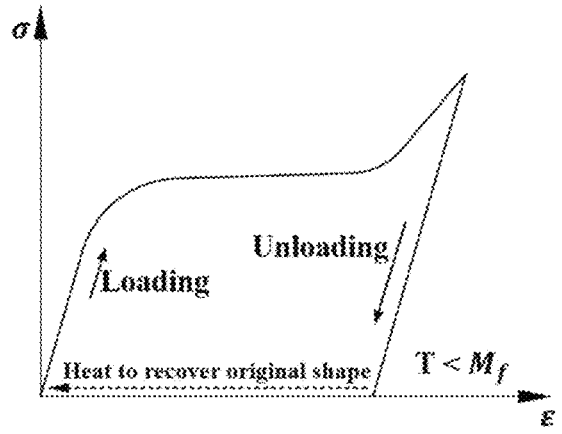
FIG. 1A is a stress-strain curve showing the shape memory effect for a martensitic SMA wire, where heating is employed to recover an original shape.
Figure 1B:
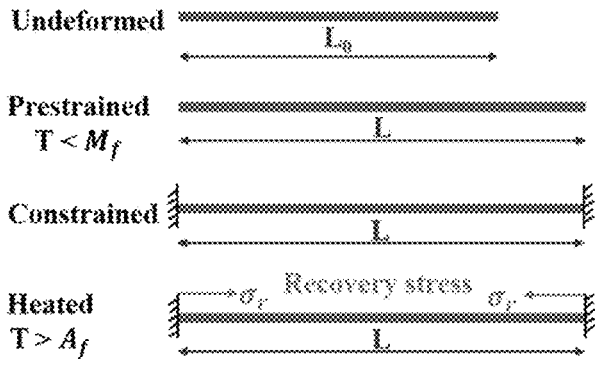
FIG. 1B shows a SMA wire in an undeformed state and having an original shape represented by length $L_0$ (top figure); the SMA wire in a deformed or prestrained state (to length L) while martensitic (second figure from top); the SMA wire constrained at each end in the deformed state such that the length L is maintained (second figure from bottom); and the constrained SMA wire upon heating above an austenite finish temperature ($A_f$), such that a compressive recovery stress is generated in the SMA wire (bottom figure).

Accordingly, after a martensitic shape memory alloy is deformed to a certain level of strain, heating the shape memory alloy to a temperature above $A_s$ can initiate the transformation between martensite and austenite. The original shape may be fully recovered when the shape memory alloy is heated to a temperature at or above $A_f$. This shape recovery process is known as the shape memory effect and is illustrated in FIG. 1A. If a prestrained shape memory alloy is constrained during heating, an internal stress is induced, as illustrated in FIG. 1B. In this example, a straight shape memory alloy (SMA) wire undergoes a tensile prestrain while martensitic, from an original length $L_0$ to a deformed length L, and the SMA wire is constrained while under tension. Thus, when heated to a temperature at or above $A_f$, the SMA wire experiences a compressive stress as it tries to recover the original length $L_0$ while remaining constrained. The inventors have recognized that this thermally-triggered induced stress may be exploited to apply an internal compressive stress on concrete (that is, to apply a compressive prestress).

Figure 2B:
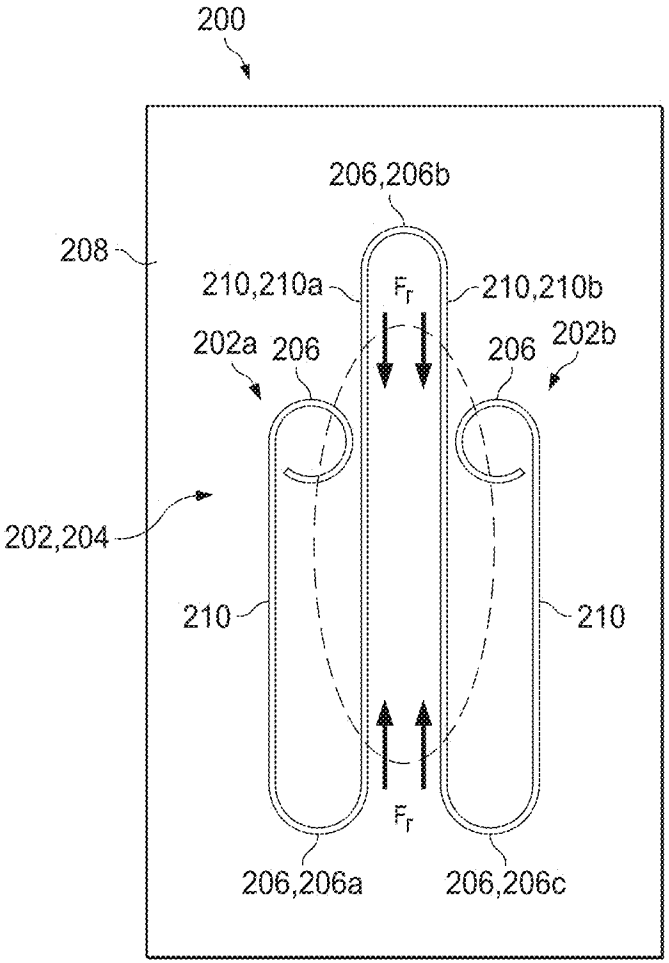
FIG. 2B is a schematic of the concrete including the embedded deformed SMA wire after heating, where the arrows indicate the direction of the compressive recovery force $F_r$.

To eliminate the need for using an anchorage system as required in conventional prestressing techniques, the use of curved or deformed shape memory alloy (SMA) wires as prestressing reinforcement is described herein. In contrast to bars, wires may have a small diameter, which enables them to be easily bent into different shapes. Taking advantage of the flexibility of SMA wires and the thermally triggered shape memory capability described above, SMA wires 202 can be bent into, for example, the sinusoidal shape 204 shown in FIG. 2A and embedded in concrete 208, forming what may be described as a precast prestressing plate ("PPP" or "plate") 200. The curved segments 206 shown in FIG. 2A may function as self-anchorage mechanisms within the concrete 208 that prevent the SMA wire 202 from recovering its original shape. In this example, both ends 202*a*,202*b* of the wire 202 are bent to provide anchorage points. During heating, the movement of the SMA wire 202 is restrained and a recovery stress is generated within the straight segments 210 of the SMA wire, as illustrated in FIG. 2B by arrows showing the direction of the compressive recovery force $F_r$. As a result, the concrete 208 enclosed within the elliptical shape shown with dashed lines may be subjected to a compressive stress (or may be prestressed). As will be discussed further below, such embedded SMA wires 202 may be heated by exposing the concrete 208 to high temperatures (if the wires 202 are relatively close to surface), by passing electric current through the SMA wires 202 to exploit electrical resistivity, or by other heating methods known in the art.

The concept of using curved SMA wires to prestress concrete or mortar envisages a wide range of applications including new construction applications and existing structural applications such as repair or strengthening applications. For example, as shown in FIGS. 3A-3F, a plate 200 made of mortar or concrete 208 and including an embedded deformed SMA wire 202 can be used to apply external prestressing on an existing structure 310, such as a bridge girder 312, to improve its shear behavior or flexural behavior. The plate 200 can be secured to any localized region 318 of the girder 312 where external strengthening and/or prestressing is needed (e.g., to the web 314 or flange 316). Once installed, the SMA prestressing force may be thermally activated, transferring the force from the SMA wire 202 to the girder 312 by passing through the interface between the plate 200 and the girder 312. For this external prestressing to be successfully implemented, it is crucial that sufficient composite action is formed between the plate 200 and the surface of the girder 312 or other structure 310. This composite action can be facilitated or ensured by effectively connecting the plate 200 with the structure 310, as discussed further below.

Figure 4:
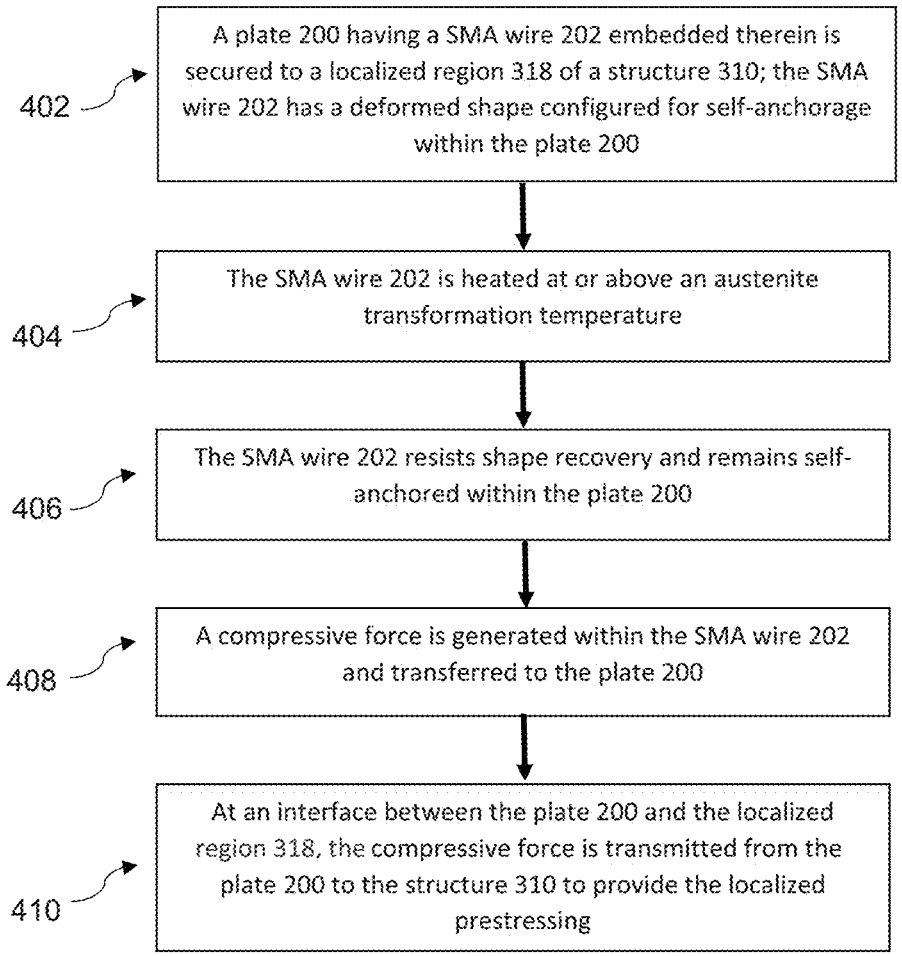
FIG. 4 is a flow chart of a method to strengthen or repair concrete and other structures.
Figure 5A:
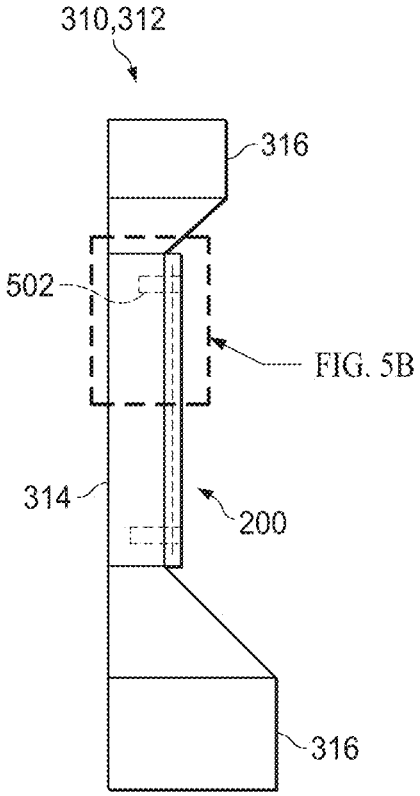
FIGS. 5A-5C show a PPP secured to a local region of a structure (this example, a web of a bridge girder) using anchoring rods, where
Figure 5B:
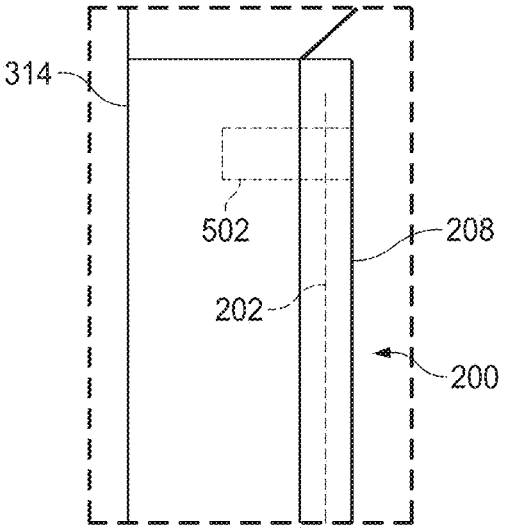
Figure 5C:
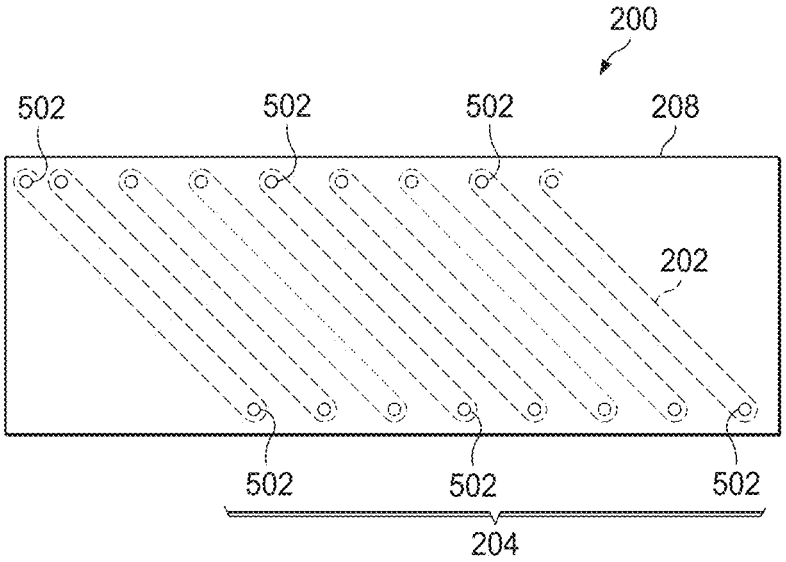
Figure 5D:
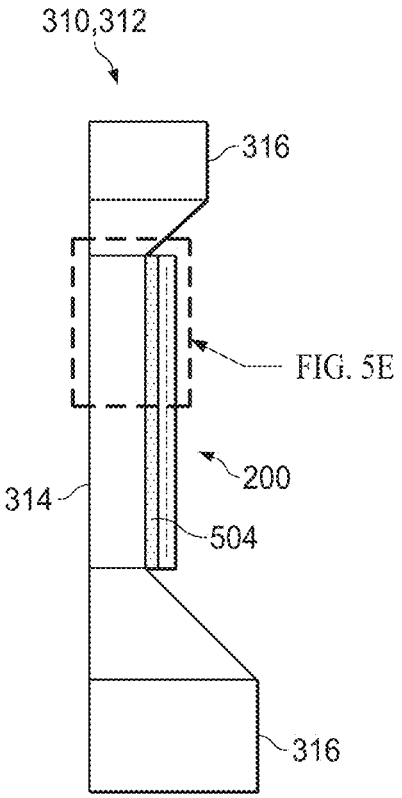
FIGS. 5D and 5E show a PPP secured to a local region of a structure (in this example, a flange of a bridge girder) using an adhesive, where
Figure 5E:
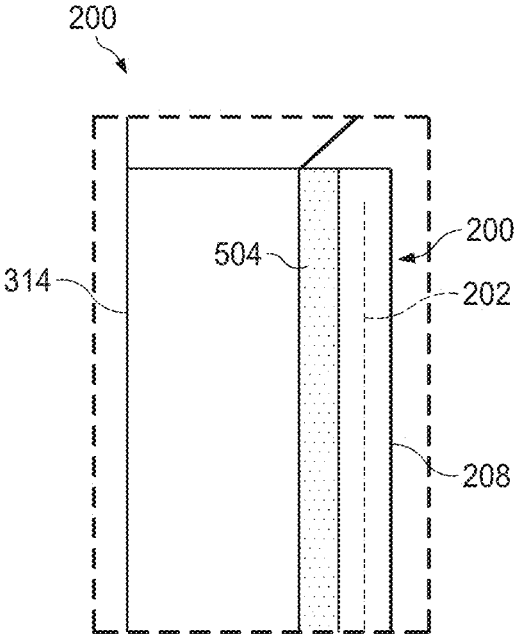

Referring now to the flow chart of FIG. 4 in conjunction with FIGS. 3A-3F, a method to strengthen or repair concrete and other structures includes securing 402 a plate 200 having a SMA wire 202 embedded therein to a localized region 318 of a structure 310. The SMA wire 202 has a deformed shape configured for self-anchorage within the plate 200. The SMA wire 202 is heated 404 at or above an austenite transformation temperature, which triggers the SMA wire 202 to "remember" and attempt to recover an original shape. The SMA wire 202 resists 406 shape recovery and remains self-anchored within the plate 200, thereby generating 408 a compressive force within the SMA wire 202 and transferring the compressive force to the plate 200. At an interface between the plate 200 and the localized region 318 of the structure 310, the compressive force is transmitted 410 from the plate 200 to the structure 310, thereby providing the localized prestressing. Experiments reveal that values of compressive prestress in a range from about 2 MPa to about 10 MPa may be achieved, with higher values of compressive prestress (e.g., from about 6 MPa to about 10 MPa) being possible with preferred geometries. In addition, values of prestress above 10 MPa, such as >10 MPa to about 25 MPa, may be achieved using a larger-diameter SMA wire (e.g., >2 mm to about 5 mm).

The structure 310 may comprise concrete, steel, a metal alloy, masonry, stone, brick and/or another building material. The structure 310 may be, in typical examples, a concrete girder, a concrete beam, a concrete column, or another concrete structure.

Figure 3B:
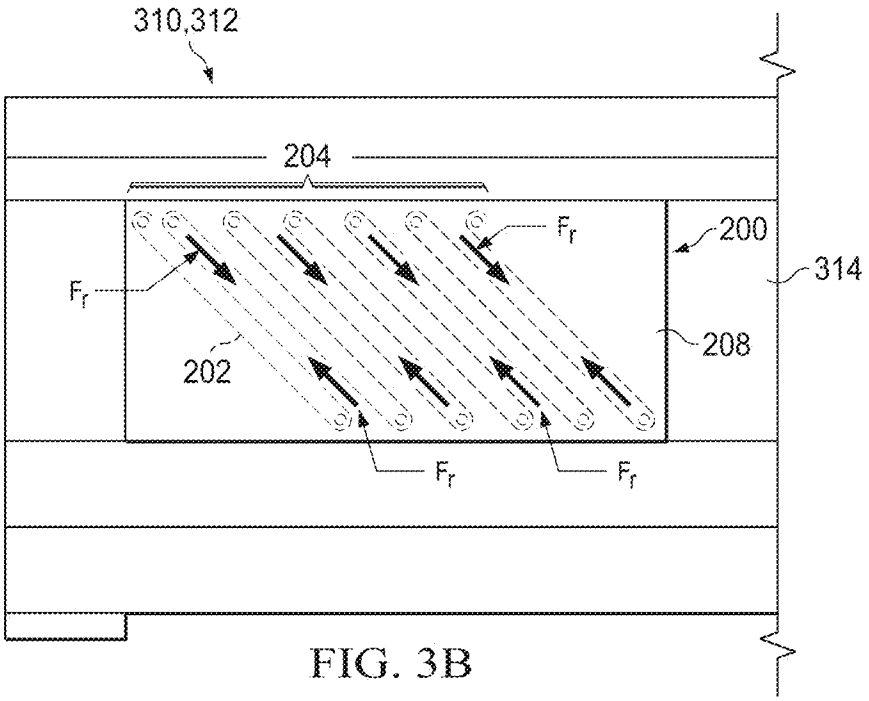
FIGS. 3A-3C show a potential application of precast prestressing plate (PPP) in shear retrofit/repair, where, in FIG. 3A, the PPP is secured to the web of a girder where external strengthening/prestressing is needed.
Figure 3C:
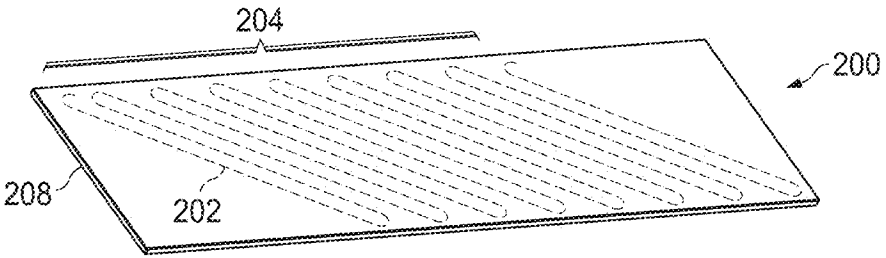
Figure 3A:
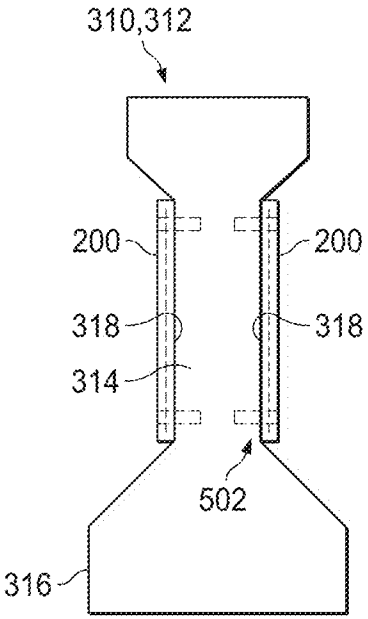
Figure 3E:
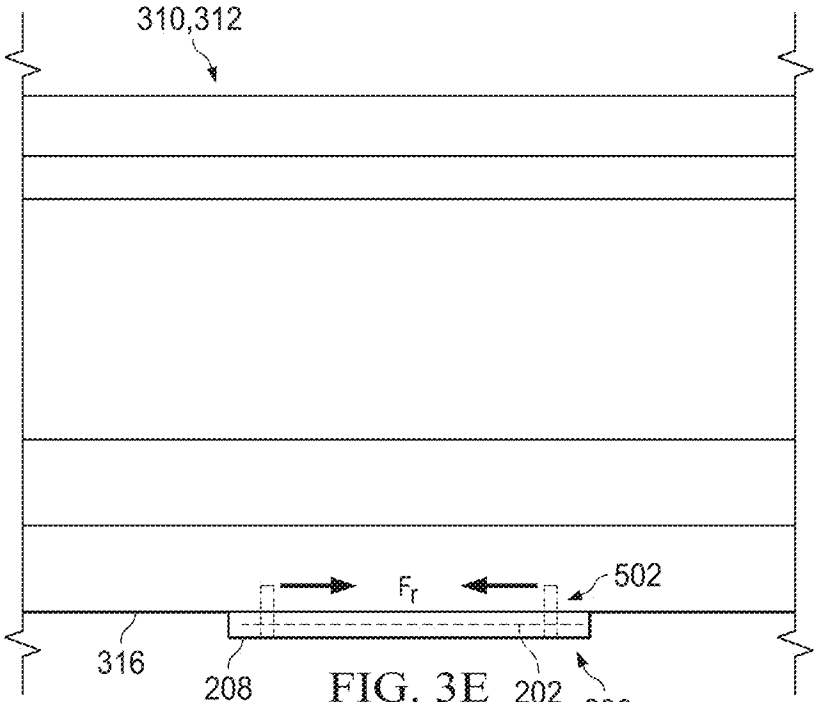
FIGS. 3D-3G show a potential application of PPP in flexural retrofit/repair, where, in FIG. 3D, the PPP is secured to the flange of the girder where external strengthening/prestressing is needed.
Figure 3D:
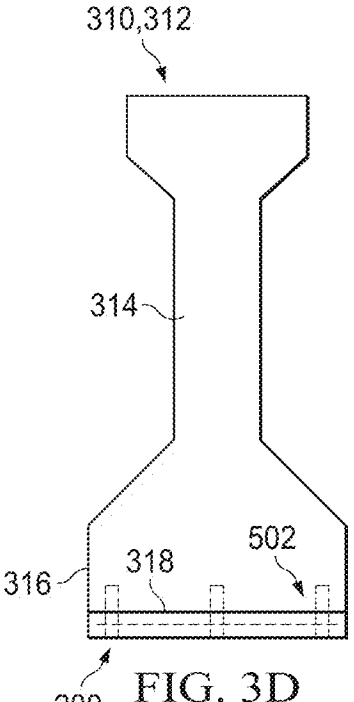
Figure 3F:
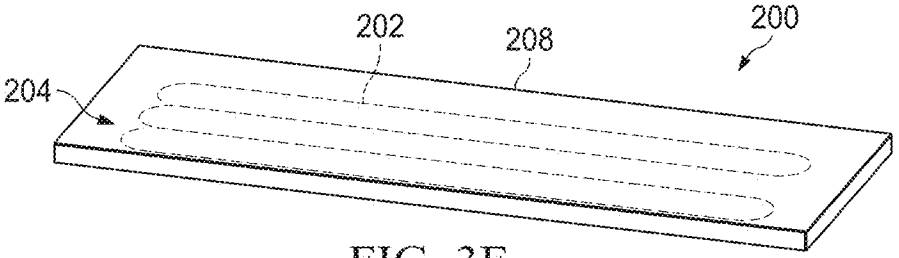
Figure 3G:
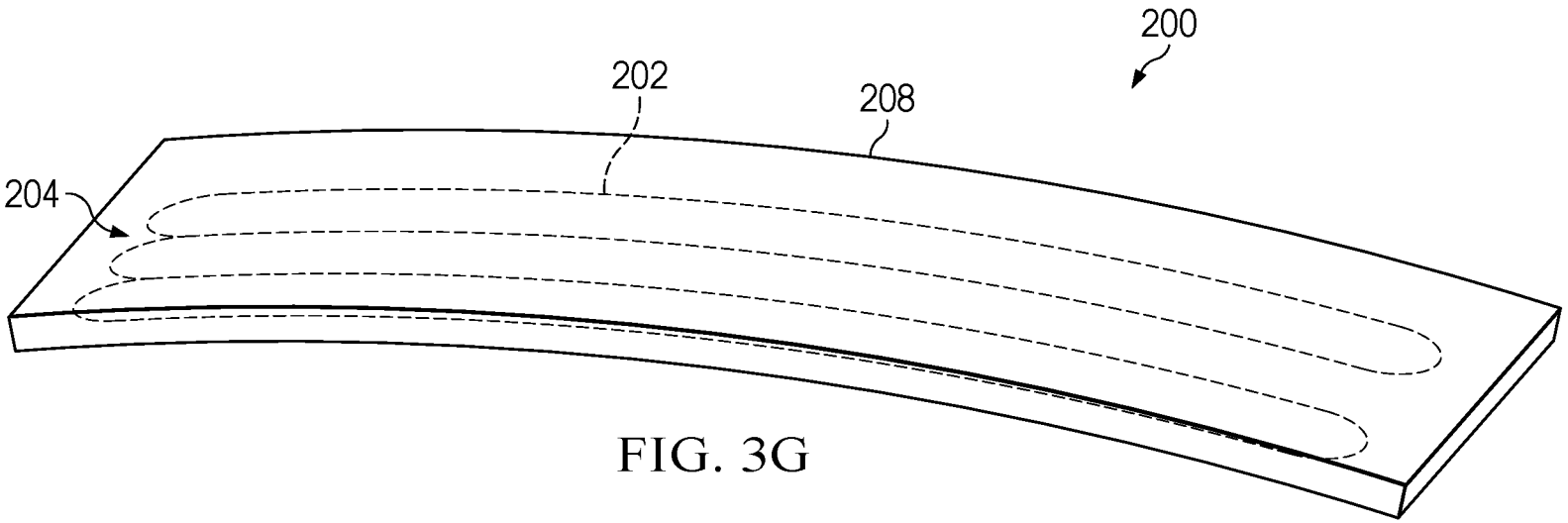

The plate 200 may comprise concrete or mortar 208, where the SMA wire 202 is embedded within the concrete or mortar 208. The SMA wire 202 may be partially or fully embedded within the concrete or mortar 208. The SMA wire 202 may comprise a shape memory alloy such as a nickel-titanium alloy, an iron-manganese-silicon alloy, an iron-nickel-cobalt-titanium alloy, a copper-zinc-aluminum alloy, or a copper-aluminum-nickel alloy. For example, the shape memory alloy may be a nickel-titanium-niobium alloy. Typically, the wire has a diameter in a range from about 0.5 mm to about 5 mm. The plate 200 may be substantially flat, as shown for example in FIGS. 3C and 3F. Alternatively, as shown in FIG. 3G, the plate 200 may be curved and/or shaped to mate with the localized region 318 of the structure 310. The localized region 318 may be a damaged region of the structure 310, and the plate 200 may have a length and/or width larger than the damaged region. Typically, the plate 200 has a thickness in a range from about 5 mm to about 50 mm.

The plate 200 may be secured to the localized region 318 of the structure 310 using anchoring rods 502 and/or an adhesive 504, as shown for example in FIGS. 5A-5E. The anchoring rods 502 may be steel anchoring rods and the adhesive 504 may comprise an epoxy adhesive, as discussed in the examples below, where the effectiveness of different connection methods in transferring the prestressing force from the plate 200 to the structure 310 is evaluated. Once secured, the plate 200 may have a predetermined orientation with respect to the localized region 318 based on a direction of the compressive force. For example, the predetermined orientation of the plate 200 may align the compressive force substantially perpendicular to cracks in the localized region 318.

The heating may comprise exposing the plate 200 to an elevated temperature and/or passing an electric current through the SMA wire 202. In the latter case, ends of the SMA wire 202 may be exposed for electrical connection, and/or the plate 200 may further include lead wires partially embedded therein, where the lead wires have embedded ends electrically connected to the SMA wire 202 and exposed ends configured for electrical connection to an external power source.

The austenite transformation temperature to which (or beyond which) the SMA wire 202 is heated may be an $A_s$ temperature or an $A_f$ temperature of the shape memory alloy. The compressive force may be maintained within the SMA wire 202 even after the heating is halted. To facilitate this, the $M_s$ temperature of the SMA wire 202 may be lower than temperatures to which the structure 310 is exposed in use. For example, the $M_s$ and/or $M_f$ temperatures may be well below typical outdoor temperatures, such as below −30° C., below −40° C., or below −50° C. Similarly, the $A_s$ and $A_f$ temperatures of the SMA wire 202 may be above typical indoor and/or outdoor temperatures to ensure that the transformation from martensite to austenite to induce contraction of the SMA wire 202 does not commence prematurely. For example, one or both of the $A_s$ and $A_f$ temperatures may be above 40° C., above 45° C., or above 50° C. Consistent with this, the SMA wire 202 may exhibit a large thermal hysteresis, such as at least about 80° C., or at least about 100° C., to ensure that the prestressing is maintained during use (e.g., in the field).

Figure 2A:
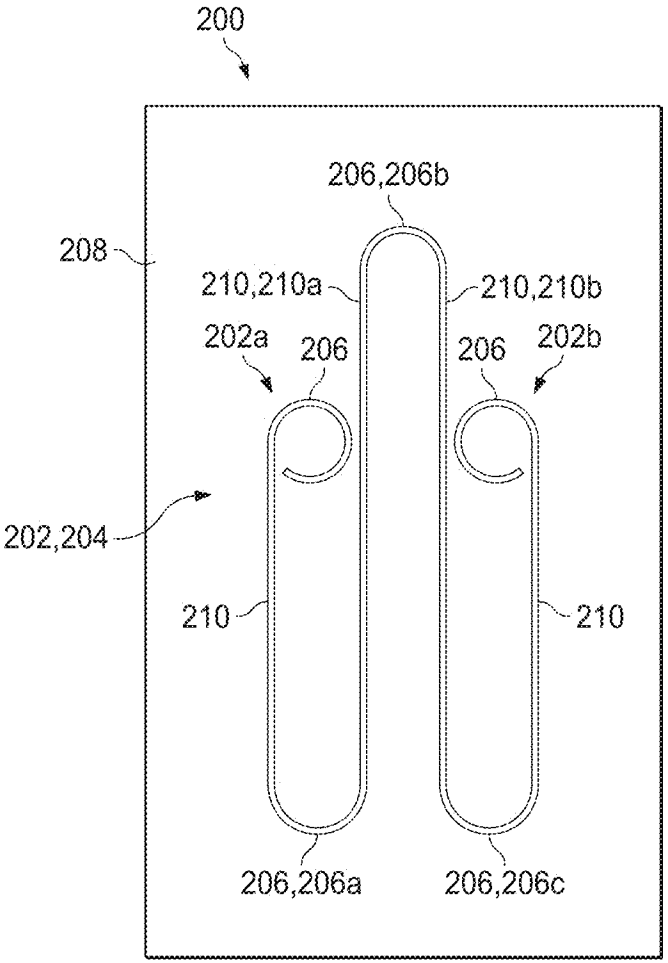
FIG. 2A is a schematic of concrete including an embedded deformed SMA wire before heating.

As illustrated in FIGS. 2A and 2B, the deformed shape of the SMA wire 202 may be a sinuosoidal shape 204 comprising curved segments 206 separated by straight segments 210. The sinusoidal shape 204 may include at least three curved segments 206, where a first curved segment 206*a* is separated from a second curved segment 206*b* by a first straight segment 210*a*, and the second curved segment 206*b* is separated from a third curved segment 206*c* by a second straight segment 210*b*. The straight segments 210 may be substantially parallel to each other. Individually, the straight segments 210 may be from two to twenty times longer than the curved segments 206. Generally speaking, the plate 200 may include from two to n straight segments 210, where n is a positive integer (e.g., 20, 50, 100), and from three to n+1 curved segments 206. As shown in the examples below, a reduced spacing S between the straight segments 210 tends to lead to an increase in the compressive prestress. More specifically, spacings of about 6 mm to 25 mm are investigated for a 2 mm-diameter SMA wire, and the highest values of compressive prestress are obtained for the smallest (6 mm) spacing. Accordingly, preferred spacings S for a typical SMA wire may lie in a range from about 5 mm to about 15 mm, or from about 5 mm to about 10 mm.

Each curved segment 206 may span from about 120° to about 360°, or more typically from about 150° to 180°, to promote secure anchoring in the plate 200. Advantageously, due to the anchoring effect imparted by the deformed shape of the wire 202, the method may be carried out with a smooth SMA wire 202, which is free from surface features such as ribs, corrugations and/or bumps. Alternatively, to enhance anchoring or bonding within the concrete structure, the SMA wire 202 may include such surface features.

The method may further comprise, prior to securing the plate 200 to the localized region 318 of the structure 310, fabricating the plate 200. Fabrication may include forming the SMA wire into the deformed shape, which may be a tensioned or elongated shape. Typically this entails exerting tensile and bending forces on the SMA wire. In other words, a tensile and/or bending stain may be applied to the SMA wire to ensure that contraction occurs during the heating described above. The forming step in particular and fabrication in general may be carried out while the SMA wire is martensitic and thus readily deformable. Prior to forming the SMA wire into the deformed shape, the SMA wire may undergo a heat setting process as known in the art in order to impart a "memory" of the pre-tensioned configuration. This is the configuration to which the SMA wire segment attempts to return upon heating at or above the austenite transformation temperature while constrained, so as to produce the desired compressive stress.

After forming the SMA wire into the deformed shape, the SMA wire may be positioned in a mold, and a mortar or concrete mix may be poured into the mold and over the SMA wire. Finally, the mortar or concrete mix may be cured to obtain the plate including the SMA wire embedded therein. The curing may occur over a suitable time period, such as from about 14 days to about 28 days, typically. Suitable compositions for the mortar or concrete mix are known in the art.

EXAMPLES

Fabrication of Plate with Embedded SMA Wire

Figure 6:
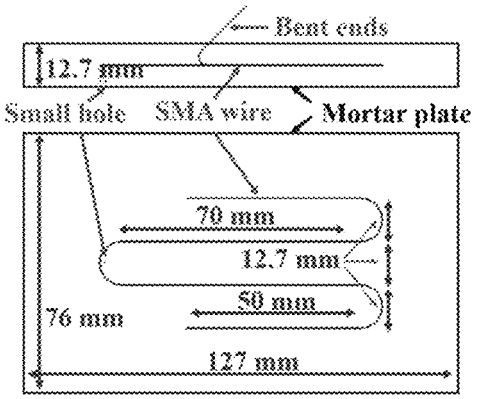
FIG. 6 includes side-view and top-view schematics of a fabricated and tested PPP specimen.

Referring now to FIG. 6, a 127 mm×76 mm×12.7 mm mold is built to cast a mortar plate for testing. The SMA wire used in this study is made of a NiTiNb alloy, which is one type of SMA among a few SMAs that are commercially available in the U.S. The NiTiNb alloy is selected due to its wide thermal hysteresis and relatively high recovery stress. With a thermal hysteresis width over 120° C., the NiTiNb SMA can maintain its recovery stress (about 550 MPa) under a wide range of ambient temperatures. A 2 mm-diameter NiTiNb SMA wire with approximately 6% prestrain is bent into a sinusoidal shape and placed in the mold. The curved SMA wire is placed approximately at mid-height of the specimen/mold. After the curved SMA wire is in position, the mortar mix is poured into the mold. The top surface of the specimen is smoothened by trowel. 102 mm×203 mm cylinders are cast to determine the compressive strength of mortar on the day of testing as well as to obtain the stress-strain curve of the mortar. The specimen is demolded after 24 hours and cured for 28 days before heating is applied.

Testing of Fabricated Plate

Strains induced within the specimen during prestressing are monitored using strain gages and digital image correlation (DIC). As a state-of-art optical technology, DIC can measure the strain or displacement of an object by building correlation between images taken before and after deformation of the object. To avoid interfering with the camera used for capturing DIC images, direct heating of SMA using propane torch is not used. Instead, the SMA is heated using electrical resistivity by connecting the two exposed ends of the wire to a power source. A high-temperature strain gage is attached to a backside of the specimen to monitor the mortar strain during and after heating and provide information on the prestressing level.

Strain distribution data from DIC reveal that, after the SMA wire is fully activated, the area bounded by the SMA curved segments is prestressed. Since the geometry of the SMA wire is symmetric, the strain distribution is symmetric in general as well. The strain gauge readings reveal that, once the heating is finished, the mortar cools down to room temperature and a stable recovery stress is reached within the SMA wire; hence, the strain readings stabilized and reached about 360με in compression. Based on the stress-strain response from the mortar cylinder tests, the corresponding compressive stress when strain reached 360με was approximately 10.9 MPa. These results indicate the validity of the prestressing technique using a curved SMA wire.

Testing of PPP Connections

Figure 7:
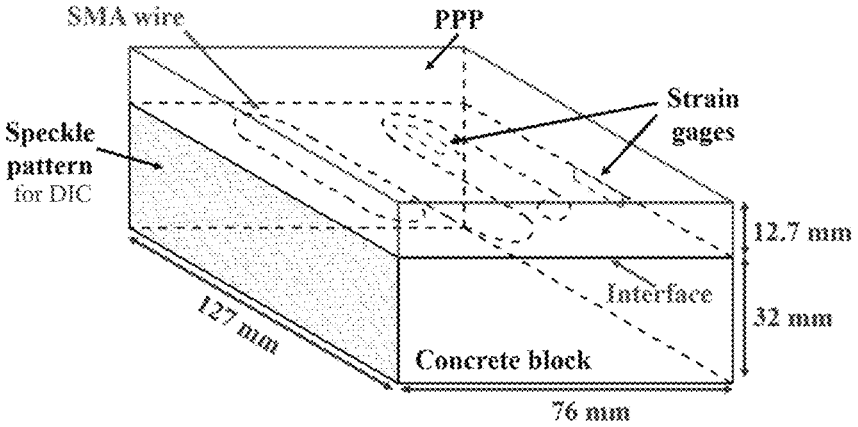
FIG. 7 is a schematic showing the layout of the PPP specimen secured to a concrete block for connection testing.

To explore the effectiveness of different connections between PPP and base concrete, three specimens with different types of connections are studied experimentally. All three specimens include a 76 mm×127 mm×31.7 mm base unreinforced concrete block structures externally prestressed with a 76 mm×127 mm×13 mm PPP as illustrated in FIG. 7. The block and plate are connected together using three different methods including: 1) steel anchors ("SP-S"), 2) epoxy adhesive ("SP-E"), and 3) hybrid connection ("SP-SE") combining both steel anchors and epoxy. Rapid set mortar mix and rapid set concrete mix are used to cast the mortar plates and the concrete blocks, respectively.

The compressive strength of the base block concrete and mortar plate are 48.3 MPa and 35 MPa, respectively. The effectiveness of the connection in transferring the prestressing force from the prestressing plate to the base block is evaluated by monitoring the compressive strain induced in the base concrete block. The test setup and instrumentation are designed to capture such compressive strain. The strains developed in the mortar plate and concrete block are monitored to determine the prestressing stress induced by the activation of SMA wire. The readings of the strain gage on the concrete block are compared to the results from DIC analysis to verify the accuracy of DIC data.

For specimen SP-S, steel anchors are used to connect the base concrete block and the mortar PPP. Before the mortar plate is cast, the SMA wire is deformed into a sinusoidal shape and placed at the mid-height of the mold. Three steel rods with diameter of 7.9 mm are placed at the center of the curved sections of the SMA. These rods serve as anchors that connect the mortar plate with the top of concrete block. The three holes required for installing the rods are introduced within the mortar plate during casting using wood rods identical in diameter to the steel rods. Furthermore, three holes 8.3 mm diameter and 25 mm deep are drilled in the concrete block at locations matching those in the mortar plate. A slightly larger diameter is used for the concrete block holes to ensure the ease of installation of steel rods. In order to prevent prestressing loss due to the small gap between the steel rods and holes, epoxy is applied to fill the gap between anchors and concrete.

Specimen SP-E is similar to SP-S except that the mortar plate is secured to the concrete block using an epoxy adhesive instead of steel rods. To improve the adhesion at the interface between epoxy and mortar/concrete, the interface of both the mortar plate and the concrete block is treated with sanding and steel-wire brushing before the epoxy adhesive is applied.

Finally, specimen SP-SE combines both methods, namely, an epoxy adhesive and steel anchors to secure the mortar plate to the concrete block. Due to the bond provided by the epoxy, the number and size of the anchor steel rods are reduced compared to specimen SP-S to two steel rods with a diameter of 6.4 mm.

Readings from the strain gages of all three specimens as well as from DIC analysis at the opposite point where the strain gage is attached are summarized in Table 1. The strains presented in the table are the final readings when the specimens had already cooled down to room temperature. For all the specimens, compressive strains are detected by strain gages on the side of the concrete block and at the center of the mortar plate, which indicates that all three installation methods (steel anchors, epoxy adhesive, and anchors+epoxy (hybrid)) are able to transfer the prestressing force from the PPP to the concrete block. The presence of epoxy adhesive helps in providing more uniform distribution of the transferred stress. It also reduces the labor needed for anchor installation.

TABLE 1

Summary of the test results of the three specimens

| | Concrete | | | Mortar | |
|---|---|---|---|---|---|
| Specimens | Strain gage (με) | DIC (με) | Prestressing stress (MPa) | Strain gage (με) | Prestressing stress (MPa) |
| SP-S | 75 | 72 | 2.47 | 205 | 5.74 |
| SP-E | 60 | 64 | 1.97 | 115 | 3.22 |
| SP-SE | 89 | 83 | 2.92 | 215 | 6.02 |

Parametric Study

Figure 8:
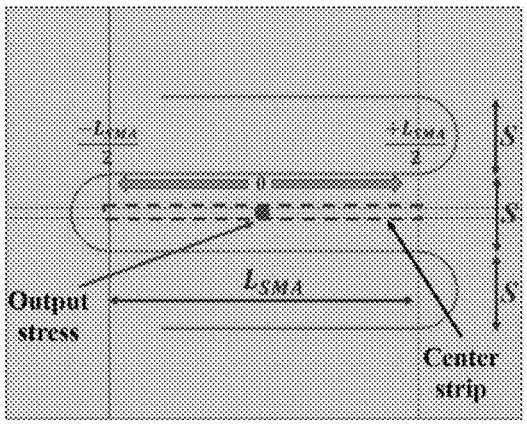
FIG. 8 shows variables considered in a parametric study using a finite element model of the PPP specimen.

A validated finite element (FE) model based on the above-described proof of concept specimen, which comprises a mortar plate and embedded SMA wire, is utilized to analyze parameters that may affect the prestressing value. The investigated variables in this study are the spacing (S) and the length ($L_{SMA}$) of the SMA wire, as shown in FIG. 8. The seven cases considered for the parametric study along with the output prestress value for each case are listed in Table 2. Four different values are assigned to each variable. The models with spacing S of 6.4 mm, 12.7 mm, 19.0 mm, and 25.4 mm are labeled as S1, S2, S3, and S4, respectively. Similarly, the $L_{SMA}$ values of 76.2 mm, 152.4 mm, 228.6 mm, and 304.8 mm are represented by L1, L2, L3, and L4, respectively. For example, model S3-L2 in the table is for the case with SMA spacing equal to 19.0 mm and $L_{SMA}$ equal to 152.4 mm. To further investigate the stress distribution in each of the studied cases, the values of the compressive stress along the center strip indicated in FIG. 8 with a length of $L_{SMA}$ is recorded and compared for all cases. Also, the stress at the middle point of the center strip indicated in FIG. 8 is reported in Table 2 under Output Prestress. It is seen from the table that the prestressing stress declines as the spacing and length of the SMA wire increases.

TABLE 2

Parametric study matrix and results

| Model | Spacing (mm) | Length (mm) | Output Prestress (MPa) |
|---|---|---|---|
| S1-L1 | 6.4 | 76.2 | 9.6 |
| S2-L1 | 12.7 | 76.2 | 7.6 |
| S3-L1 | 19.0 | 76.2 | 6.3 |
| S4-L1 | 25.4 | 76.2 | 5.4 |
| S3-L2 | 19.0 | 152.4 | 3.7 |
| S3-L3 | 19.0 | 228.6 | 2.7 |
| S3-L4 | 19.0 | 304.8 | 2.7 |

Figure 9A:
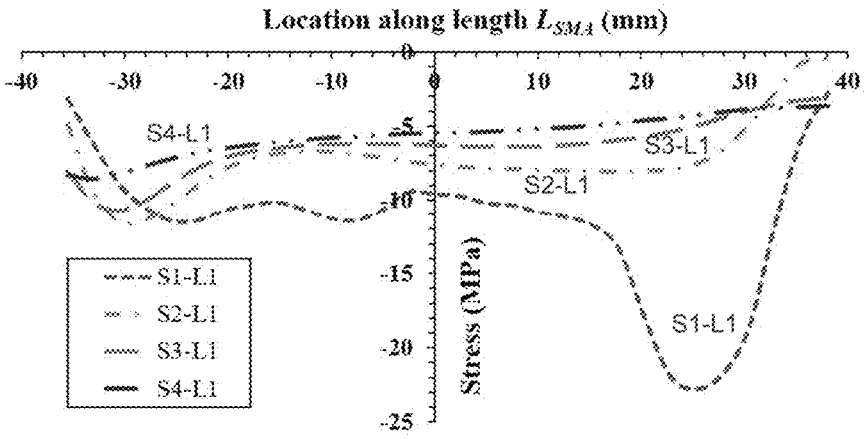
FIG. 9A shows stress distribution with different spacings, S.

FIG. 9A represents the stress distribution of the center strip for the models with fixed $L_{SMA}$ and various spacings S. From the figure it is observed that, in general, the stresses around the left and right ends of the center strip are relatively high and evolve into smaller values as the location approaches the middle of the center strip. One special case is S1-L1, where the compressive stress is much higher than the other cases around the right end of the center strip. This is because the two stress concentration areas are moved closer to each other as the spacing is reduced to 6.4 mm, and the compressive stress flow overlaps. This overlap gives rise to the higher prestressing stress.

From Table 2 it can be seen that for same length of SMA wire, the prestressing stress increases by 77.8% from 5.4 MPa to 9.6 MPa as the spacing decreases from 25.4 mm to 6.4 mm. With the increase of spacing, the two compressive regions move away from each other with little or no overlapped area left, which causes the reduction in the prestressing stress. As a result, in the case of S4-L1, where the spacing of SMA wire is highest among the studied cases, the prestress stress is the lowest among all the cases.

Figure 9B:
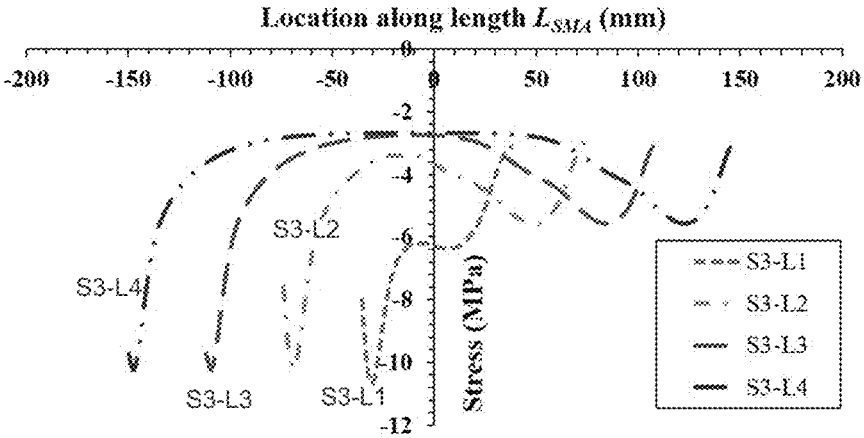
FIG. 9B shows stress distribution with different lengths, $L_{SMA}$.

The effect of SMA length ($L_{SMA}$) is explored by varying the length while keeping the spacing fixed at 19 mm. FIG. 9B depicts the stress distribution of the center strip with different lengths of the SMA wire. The figure exhibits a similar pattern for all the cases showing a higher stress around both ends of the center strip and a smaller stress at the middle section. Due to the stress concentration at the curved segments of the SMA wire and the overlapping effect, the compressive stress is higher around both ends of the center strip and starts decreasing toward the middle. Since the spacing S is identical for all cases, the stress level on both ends is quite close for all the cases. As the length of SMA wire keeps increasing, the prestressing stress decreases until a plateau with a constant stress of 2.7 MPa is reached.

The FE analysis indicates that more uniform prestressing stress is achieved at longer lengths of the SMA wire. For the same volume ratio of the SMA wire, a smaller spacing may result in a higher prestressing stress due to the stress overlapping effect. In practical applications, the spacing and length of the SMA wire may be changed based on the desired performance and prestressing level.

Although the present invention has been described in considerable detail with reference to certain embodiments thereof, other embodiments are possible without departing from the present invention. The spirit and scope of the appended claims should not be limited, therefore, to the description of the preferred embodiments contained herein. All embodiments that come within the meaning of the claims, either literally or by equivalence, are intended to be embraced therein.

Furthermore, the advantages described above are not necessarily the only advantages of the invention, and it is not necessarily expected that all of the described advantages will be achieved with every embodiment of the invention.

The invention claimed is:

1. A method to strengthen or repair concrete and other structures, the method comprising:

securing a plate having a shape memory alloy (SMA) wire embedded therein to a localized region of a structure, the SMA wire having a deformed shape configured for self-anchorage within the plate;

heating the SMA wire at or above an austenite transformation temperature, the SMA wire resisting shape recovery and remaining self-anchored within the plate, a compressive force thereby being generated within the SMA wire and transferred to the plate, wherein, at an interface between the plate and the localized region of the structure, the compressive force is transmitted from the plate to the structure, thereby providing localized prestressing of the structure.

2. The method of claim 1, wherein the plate comprises concrete or mortar, and the SMA wire is embedded within the concrete or mortar.

3. The method of claim 1, wherein the plate is substantially flat, curved, and/or is shaped to mate with the localized region of the structure.

4. The method of claim 1, wherein the plate is secured to the localized region of the structure using anchoring rods and/or an adhesive.

5. The method of claim 1, wherein the plate has a predetermined orientation with respect to the localized region of the structure based on a direction of the compressive force.

6. The method of claim 5, wherein the predetermined orientation of the plate aligns the compressive force substantially perpendicular to cracks in the localized region.

7. The method of claim 1, wherein the austenite transformation temperature is an austenite start ($A_s$) temperature or an austenite finish ($A_f$) temperature of the SMA wire.

8. The method of claim 1, wherein the heating comprises exposing the plate to an elevated temperature and/or passing an electric current through the SMA wire.

9. The method of claim 8, wherein ends of the SMA wire are exposed for electrical connection thereto.

10. The method of claim 1, further comprising halting the heating, the compressive force being maintained within the SMA wire after the heating is halted.

11. The method of claim 1, wherein a martensite start ($M_s$) temperature of the SMA wire is lower than temperatures to which the structure is exposed in use.

12. The method of claim 1, wherein the SMA wire comprises a shape memory alloy selected from the group consisting of: a nickel-titanium alloy, a nickel-titanium-niobium alloy, an iron-manganese-silicon alloy, an iron-nickel-cobalt-titanium alloy, a copper-zinc-aluminum alloy, and a copper-aluminum-nickel alloy.

13. The method of claim 1, wherein the SMA wire exhibits a thermal hysteresis of at least about 100° C.

14. The method of claim 1, wherein the deformed shape of the wire is a sinuosoidal shape comprising curved segments separated by straight segments.

15. The method of claim 14, wherein, individually, the straight segments are from two to twenty times longer than the curved segments.

16. The method of claim 14, wherein the straight segments are substantially parallel to each other.

17. The method of claim 14, wherein the sinusoidal shape includes at least three curved segments, a first curved segment being separated from a second curved segment by a first straight segment, and the second curved segment being separated from a third curved segment by a second straight segment.

18. The method of claim 1, wherein the structure comprises concrete, steel, a metal alloy, masonry, stone, brick and/or another building material.

19. The method of claim 1, further comprising, prior to securing the plate to the localized region of the structure, fabricating the plate by:

forming the SMA wire into the deformed shape, the SMA wire being martensitic;

positioning the SMA wire having the deformed shape in a mold;

pouring a mortar or concrete mix into the mold and over the SMA wire; and curing the mortar or concrete mix to obtain the plate comprising the SMA wire embedded therein.

20. The method of claim 19, wherein forming the SMA wire into the deformed shape comprises exerting tensile and bending forces on the SMA wire.

* * * * *